United States Patent [19]

Nichols, Jr.

[11] 3,968,535

[45] July 13, 1976

[54] CLEANING IMPLEMENT INCLUDING A SPONGE, SQUEEGEE, SCRAPER AND BRUSH

[76] Inventor: Harry S. Nichols, Jr., 5675 Sussex Road, Troy, Mich. 48084

[22] Filed: Mar. 20, 1975

[21] Appl. No.: 560,300

[52] U.S. Cl. ..... 15/105; 15/113; 15/114; 15/117; 15/121

[51] Int. Cl.[2] ..... A47L 1/08; A47L 23/04; B60S 1/04

[58] Field of Search ..... 15/105, 111, 113, 114, 15/116 A, 117, 118, 121, 220 R, 232, 245; 401/16, 18, 24–27

[56] References Cited

UNITED STATES PATENTS

| | | | |
|---|---|---|---|
| 913,304 | 2/1909 | Petersen | 15/111 X |
| 3,307,212 | 3/1967 | Mac Innes | 15/111 |

FOREIGN PATENTS OR APPLICATIONS

| | | | |
|---|---|---|---|
| 584,387 | 10/1959 | Canada | 15/121 |
| 1,162,293 | 8/1958 | France | 15/116 A |
| 1,361,018 | 4/1964 | France | 15/121 |
| 1,508,321 | 11/1967 | France | 15/121 |

*Primary Examiner*—Daniel Blum
*Attorney, Agent, or Firm*—Basile and Weintraub

[57] ABSTRACT

A cleaning device for use on car windshields and shoes, the device being of the type having the cleaning elements mounted on a head carried by a manually engageable handle. The cleaning elements include a sponge, a window squeegee, a shoe scraper, and a shoe cleaning brush.

4 Claims, 2 Drawing Figures

CLEANING IMPLEMENT INCLUDING A SPONGE, SQUEEGEE, SCRAPER AND BRUSH

BACKGROUND OF THE INVENTION

I. Field of the Invention

The present invention relates to a cleaning device and, in particular, it relates to an improved complete cleaning device for accommodating, not only the cleaning of snow, ice, and dirt off car windshields, but also the removal of debris from the shoes of the person using the device, such removal being accomplished, in part, by a unique angularly disposed brush.

II. Description of the Prior Art

Window cleaning devices of the type described herein are well known and have enjoyed widespread use. A typical cleaning device of this type is evident in the Mallory U.S. Pat. No. 3,724,017. Another type, although not limited to the cleaning of windows, is disclosed in the MacInnes U.S. Pat. No. 3,307,212. There are several other teachings on the same subject matter, including Coover, U.S. Pat. No. 960,276; Schwartz, U.S. Pat. No. 3,051,975; Urmston U.S. Pat. No. 603,581; and Vosbikian et al., U.S. Pat. No. 2,534,086. The essence of applicant's invention over the prior art is that, although many of these devices have a combination of sponge, window squeegee, and brush, not one combines these distinct tools in one unit and in the unique manner as does applicant's invention.

SUMMARY OF THE INVENTION

The present invention offers a unique multiple purpose tool which, being manually held, provides a compact, lightweight device with means for scraping and sponging windows, brushing snow or whatever accumulation off surfaces, and removing debris from the tops and bottoms of shoes, the means for cleaning the shoes being a brush disposed at such an angle as to permit wiping the shoes with a quick, uncontorted movement and also a scraper for the shoe bottoms. Designed to be constructed of a light weight metal or plastic, the device seeks to embody four basic tools including a window squeegee, a sponge, a shoe brush, and a shoe scraper which can be handily kept in the car, and which are readily accessible to the driver during inclement weather conditions or whenever the need arises to clean the vehicle windows.

It is an object of this invention to provide a multiple purpose tool carrying a so angularly disposed brush as to effect application of the brush to snow covered shoes with an unhampered, uncontorted sweep of the arm.

Other objects, advantages, and applications of the present invention will become apparent to those skilled in the art of cleaning devices when the accompanying description of one example of the best mode contemplated for practice is read in conjunction with the accompanying drawing.

BRIEF DESCRIPTION OF THE DRAWING

The description herein makes reference to the accompanying drawing wherein like reference numerals refer to like components in the two views, and in which.

DESCRIPTION OF THE PREFERRED EMBODIMENT

Figure 1:
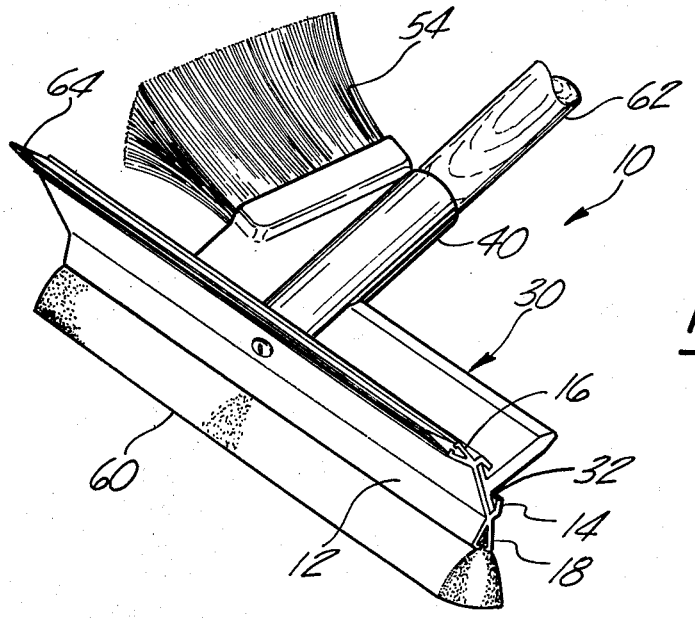
FIG. 1 is a perspective view of the windshield cleaning device with the attachment in position.

Referring now to the drawing wherein is illustrated one example of the present invention in the form of a cleaning device 10 comprising a rectangular plate 12 having a pair of window squeegee attaching legs 16 and a pair of sponge attaching legs 18.

Figure 2:
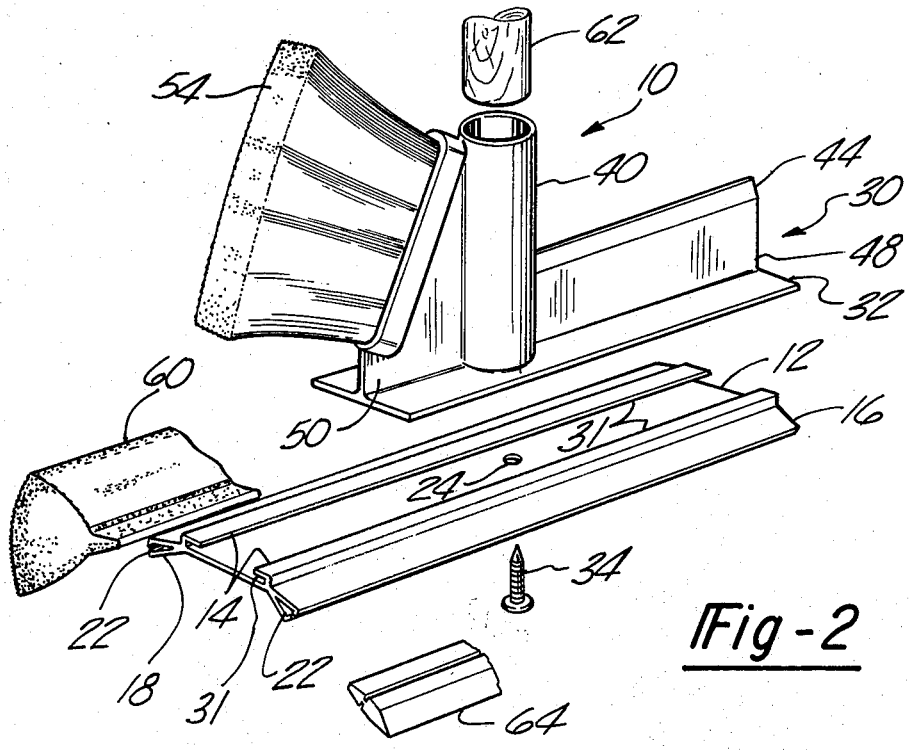
FIG. 2 is an exploded perspective view of the windshield cleaning device illustrated in FIG. 1.

Referring now to FIG. 2 where it can best be seen that the window squeegee attaching legs 16 and the sponge attaching legs 18 both terminate in V-clamps 22 which extend the full length of the upper plate 12. The V-shaped clamps serve to clip a sponge 60 and a window squeegee 64 (which is made of a flexible material such as rubber) to the plate 12 and to hold the same in a secure position while in use.

In addition to carrying the legs 16 and 18 for effecting the attachment of the sponge 60 and the window squeegee 64 to the device 10, the plate 12 also carries, adjacent to and obtusely angled from each of the legs 16 and 18, legs 14 which extend the length of the plate 12 and which form channels 31 to receive a T-shaped attachment unit 30. An aperture 24 is also centrally located on the plate 12 to accommodate a screw 34 which is inserted from the underside of the plate 12 to join the handle 62 housed in a handle receiving cylinder 40 as described hereafter.

The attachment unit 30 comprises the handle receiving cylinder 40 with a brush 54 carried on one side of the cylinder 40 and a shoe scraper 44 integrally formed on the opposite side of the cylinder 40. The brush 54 and the shoe scraper 44 have integrally formed lateral flanges 32 on their bottom sides 50 and 48 respectively. These flanges 32 serve as a means to join the attachment unit 30 with the plate 10 by slidably engaging with the channels 31 formed on the plate 12.

To complete the cleaning device 10, a handle 62 is firmly disposed in cylinder 40. Upon the union of the attachment unit 30 to the plate 12, which union leaves the cylinder 40 firmly abutting plate 12 directly over aperture 24, the screw 34 is inserted through aperture 24 in the plate 12 and is threaded into the end of the handle 62.

The above-described cleaning device possesses the distinction of uniquely combining four tools, namely the window squeegee 64, the sponge 60, the brush 54, and the shoe scraper 44, in one compact, easy-to-store device and thus providing the car user with a handy means for coping with the inconveniences of inclement weather. In use the sponge can be dampened and used to wash dirt, bugs, and other accumulations off the windshield of a vehicle. The window squeegee is then used to remove the excess moisture from the sponge-cleaned glass. In the instance of snow accumulation, the brush can be employed to remove the snow from the windshield, but more importantly the angular placement of the brush allows the user to easily and quickly sweep off the snow on his clothes or shoe tops without contorting his body to do the brushing. The shoe sole scraper, which is integrally formed on the attachment unit, is useful for occasions when muddy terrain deposits dirt and debris on the soles of shoes. It is an essential benefit of this invention that all four tools are available and convenient to use whenever the need arises, and the compactness of the cleaning device makes it easy to keep on hand in a vehicle for immediate use.

While only one example of the present invention has been disclosed, it should be understood by those skilled in the art of such devices that other forms can be had, all coming within the spirit of the invention and scope of the appended claims.

What is claimed is as follows:

1. A multiple purpose cleaning device to be employed in washing, squeegeeing, and brushing accumulations off windshields of vehicles carrying an integral scraping surface for cleaning debris from the soles and heels of shoes comprising:

a sponge;

a window squeegee;

a plate comprising an elongated edge on one side with means for mounting the sponge and an elongated edge on the opposite side with means for mounting the window squeegee;

a T-shaped attachment comprising a handle carrying cylindrical portion;

a brush holder portion carried adjacent to and integrally formed with the cylindrical portion;

a shoe scraper carried adjacent to and integrally formed with the cylindrical portion opposite the brush holder portion, the scraper extending upwardly from the plate substantially at right angles thereto;

means on the attachment for joining it to the plate;

a brush carried by the brush holder portion with its bristles extending laterally of the cylindrical portion;

a handle carried by the handle-carrying cylindrical portion; and a means on the plate for receiving the T-shaped attachment.

2. The cleaning device described in claim 1 where the means for mounting the sponge comprise a pair of legs forming a V-shaped clamp which snappingly engages with the sponge to hold the sponge in a fixed position.

3. The cleaning device described in claim 2 where the means for mounting the window squeegee comprise a pair of legs along the edge of the plate opposite the edge of the plate carrying the sponge locking legs, the pair of legs forming a V-shaped clamp which snappingly engages with the window squeegee to hold the window squeegee in a fixed position.

4. The cleaning device described in claim 3 where the means on the plate for receiving the T-shaped attachment and the means on the T-shaped attachment for joining the attachment to the plate comprise:

a pair of laterally extending integral flanges on the shoe scrapper portion of the T-shaped attachment; and an inwardly directed leg carried adjacent to and obtusely angled from each of the sponge locking legs and the scraper locking legs, the inwardly directed legs forming a channel on the plate to receive the lateral flanges of the T-shaped attachment.

* * * * *